United States Patent [19]

Rowney

[11] 4,233,695

[45] Nov. 18, 1980

[54] SWIMMING POOL COVER WITH RAIN WATER DRAINAGE AND FILTER MEANS

[76] Inventor: Michael H. Rowney, The Highwoods, Litlington, Polegate, East Sussex, England

[21] Appl. No.: 63,031

[22] Filed: Aug. 2, 1979

[30] Foreign Application Priority Data

Aug. 4, 1978 [GB] United Kingdom ..... 32342/78

[51] Int. Cl.[3] ..... E04H 3/16; E04H 3/18

[52] U.S. Cl. ..... 4/498; 210/257; 150/52 R

[58] Field of Search ..... 4/172.12, 172, 172.13, 4/172.14

[56] References Cited

U.S. PATENT DOCUMENTS

| | | | |
|---|---|---|---|
| 3,184,764 | 5/1965 | West | 4/172.12 |
| 3,579,657 | 5/1971 | Gurriari | 4/172.12 |
| 3,982,286 | 9/1976 | Foster | 4/172.14 |

FOREIGN PATENT DOCUMENTS

| | | | |
|---|---|---|---|
| 471470 | 3/1974 | Australia | 4/172.12 |
| 1002420 | 12/1976 | Canada | 4/172.12 |
| 2330418 | 1/1975 | Fed. Rep. of Germany | 4/172 |
| 2173606 | 10/1973 | France | 4/172 |

*Primary Examiner*—Henry K. Artis

*Attorney, Agent, or Firm*—Birch, Stewart, Kolasch & Birch

[57] ABSTRACT

An improved flexible, removable cover for swimming or other pools, which reduces contamination of water in the pool and is easy to maintain, has one or more discharge openings 13 covered by a further sheet 14 secured to the cover round its periphery and provided with an opening 18 through which a filter pad 19 can be introduced into the envelope or pocket formed between the further sheet and the cover proper. The cover and further sheet may be of thermoplastic material and secured to one another by welding.

6 Claims, 3 Drawing Figures

SWIMMING POOL COVER WITH RAIN WATER DRAINAGE AND FILTER MEANS

The present invention relates to covers for swimming pools, fish ponds and similar water pools.

Covers for water pools are frequently required to prevent the ingress of dirt or waste materials, such as fallen leaves, into the pool, to prevent evaporation of the water and, in the case of swimming pools, to reduce thermal losses from the water. Covers of flexible waterproof sheet material are cheap, light in weight and easy to position and remove, but have the disadvantage that they sag in their unsupported area. They therefore tend to collect rainwater which, together with accumulated dirt and waste, may eventually find its way into the pool itself, either during removal of the cover or by bursting of the cover under the weight of an excessive load of rainwater, snow or ice.

It has previously been proposed to provide for drainage from sheet covers, with the water removed from the cover being either returned to the pool or diverted to the side of the pool to a drain or associated filtration unit. It has also been proposed, as disclosed in U.S. Pat. No. 3,982,286, to provide an area of netting in such a cover, through which rain or other water falling onto the cover can return to the pool with, twigs and other coarse debris being retained by the netting. In U.S. Pat. No. 3,184,764 a screen of glass fiber or plastic strands is secured over a drain opening in the central area of the cover for the same purpose of retaining leaves, paper and other coarse waste.

I have found that removal of twigs, leaves and other coarse material does not suffice to prevent contamination of the water in the pool by dirt entering with the water draining from the cover. Apart from dust and other fine windblown debris, organic matter such as leaves can release much fine solid material in the course of decomposition. Fitting of a conventional filter would, however, be expensive, especially in view of the rapidity with which such filters can become clogged.

In accordance with the present invention a cover for a water pool has been provided, which comprises a sheet of flexible waterproof material having at least one drainage opening therein, and means surrounding the drainage opening for removably holding a filter pad over the drainage opening in such a manner that water accumulating on the cover, when in use, can only reach the drainage opening by passing through the filter pad.

One filter pad may cover one or more openings.

The filter pad fitted to the cover, when in use may be any finely porous, true filtration medium, especially of a fibrous nature, such as paper or a resin-bonded paper or fibrous mat. When clogged with fine dirt, the filter pad can be removed and either discarded in favour of a fresh pad or, if the material is suitable, washed and replaced.

In the preferred embodiments of the invention the filter pad is held over the drainage opening or openings by an envelope or pocket formed by a further sheet of waterproof material secured in watertight manner around at least a major part of its periphery to the region of the cover surrounding the opening or openings. In one particular preferred construction a sheet of waterproof material forming the envelope or pocket is sealed to the cover around its whole periphery and is provided with a slot in its central area through which the filter pad can be introduced. Alternatively, however, the sheet may have one or more relatively small openings in its central area but may be sealed to the cover around only three sides, forming a pocket into which the filter pad can be slid to be tightly held between the openings in the envelope sheet and the cover proper.

The cover is conveniently made of a thermoplastic material, especially a synthetic thermoplastic material, which may be laminated with or reinforced by a fibrous material. The sheet material forming the pocket may be similar in composition and may be secured to the cover by tight stitching but preferably by welding or binding with an adhesive.

The drainage opening or openings in the cover may be simple holes cut in the sheet material, with or without edge reinforcement. They may, however, be constituted by a portion of mesh or other perforate material let into and secured in a gap in the cover to afford support for the filter pad to be fitted over it for the purposes of the invention.

The invention will be further described by way of example only, with reference to the accompanying drawings in which.

Figure 1:
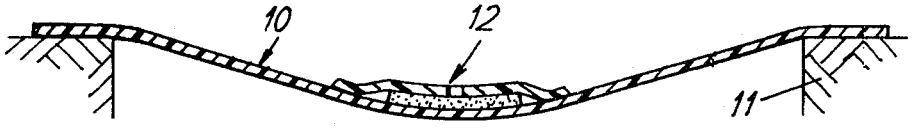
FIG. 1 is a schematic vertical section of a simple pool cover embodying the invention.

The cover 10 shown in the drawings, which is suitable, for example, for a swimming pool, is made up of sheet thermoplastic material resistant to water and weather, for example polyethylene or vinyl sheeting. In use the cover is secured in any convenient manner to the sides or edges 11 of the pool, so as to cover the entire area, and on account of its weight and its flexible nature, sags downward over the pool as shown.

Figure 2:
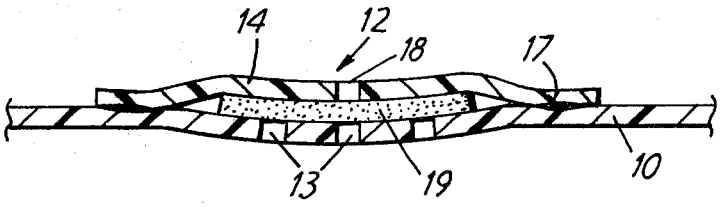
FIG. 2 is an enlarged cross-section of the drainage and filter assembly.
Figure 3:
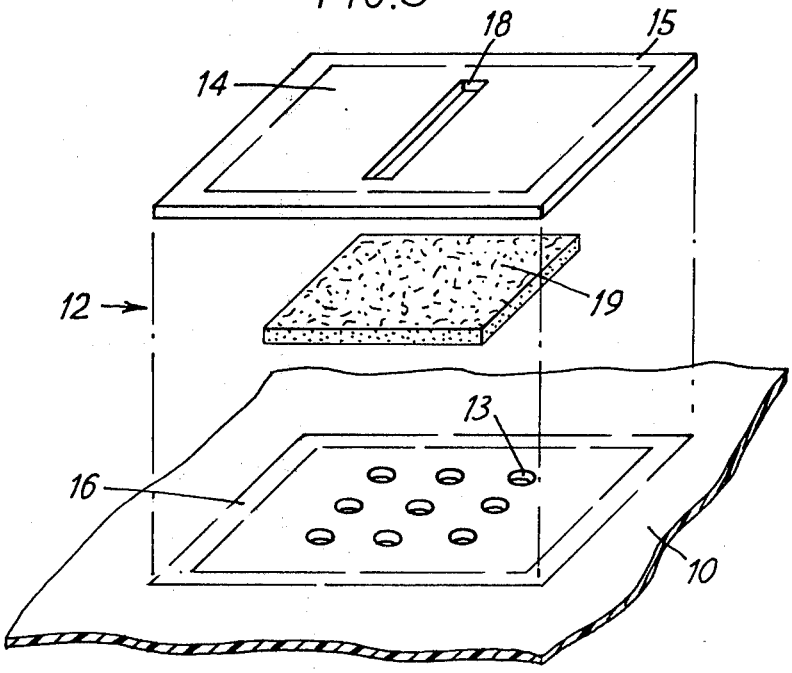
FIG. 3 is an exploded view of the three layers comprising the filter assembly.

In an area of the cover 10 which tends to be lowest in use, for example, in the central region of the cover, at least one drainage opening and filter assembly 12 are provided. As shown more clearly in FIGS. 2 and 3, one or more openings 13 are formed in the material of the cover 10, nine such openings being shown in the drawing by way of example. A top sheet 14, also of thermoplastic material and preferably of the same material as the cover, is of sufficient area to cover completely the region occupied by the openings 13 and to provide for a peripheral region 15 where it can be secured in watertight manner to the corresponding region 16 on the cover proper. The top sheet is preferably welded to the cover as indicated at 17.

The top sheet is formed with a central slot 18. The slot is of sufficient length and width for the passage of a filter pad 19 and, in use, for entry of water collected on the cover. The pad is introduced by folding it sufficiently to pass it through the slot and then opening it out inside the envelope or pocket until it is held flat to cover completely the openings 13 and to be held tightly between the top sheet 14 and the cover 10. Thus no water entering the filter envelope or pocket through the slot 18 can reach the openings 13 without passing through the pad.

The filter pad 19 is preferably fibrous in nature, for example, paper or like close fibrous mat, which may be resin-bonded to preserve its strength for safe removal when wet. Other materials which are sufficiently finely porous to give thorough filtration of water passing through them, such as certain open cell foam structures, can however be used. In the example shown in the drawing, the filter pad must be very flexible for it to be passed through the slot 18 and opened inside the envelope or pocket. Where, as in an alternative construction, the top sheet 14 is secured to the cover proper on only three sides, and the pad is slid tightly into the pocket from the fourth side, the pad need not be so flexible, but it should have enough resilience to make liquid-tight contact with the sheet 14 and cover 10 to ensure an effective filter action. With this latter construction, the slot 18 can be replaced by one or more openings of smaller dimensions.

Although in the drawing, a single filter and group of drainage openings has been shown, disposed in the central region of the cover, it is equally possible to provide a number of such filters and openings, or groups of openings, disposed as seems best having regard to the shape and design of the cover.

The invention being thus described, it will be obvious that the same may be varied in many ways. Such variations are not to be regarded as a departure from the spirit and scope of the invention, and all such modifications as would be obvious to one skilled in the art are intended within the scope of the following claims.

I claim:

1. A cover for a water pool which comprises:

a sheet of flexible, waterproof material having at least one drainage opening therein and a filter pad assembly disposed over said drainage opening, said filter pad assembly comprising a filter pad and a holding means, said filter pad having a fine, porous structure and said holding means being made of a waterproof material secured in a watertight manner around at least a major portion of its periphery to that region of the cover surrounding the drainage opening thereby forming an envelope or a pocket with said sheet, said holding means containing an opening therein for the introduction of the filter pad thereinto, whereby said filter pad is held over the drainage opening for purifying water passing from the flexible sheet through the opening in the holding means, through the filter pad, and through the drainage opening into the water pool.

2. The cover of claim 1 wherein the holding means is secured to the cover along only a major portion of its periphery so as to form a pocket for receiving said filter pad.

3. A cover according to claim 1, wherein the holding means is secured to the cover along its entire periphery and the opening provided therein is a slot for the introduction of the pad.

4. The cover of claim 1 wherein both the cover and the holding means are thermoplastic, water resistant materials.

5. A cover according to claim 1, wherein the filter pad comprises paper.

6. The cover of claim 1 wherein said cover contains a plurality of drainage openings and said filter pad assembly is adapted to cover all of said openings.

* * * * *